US010230166B2

(12) United States Patent
Savage et al.

(10) Patent No.: US 10,230,166 B2
(45) Date of Patent: Mar. 12, 2019

(54) PLASMA SWITCHED ARRAY ANTENNA

(71) Applicant: THE BOEING COMPANY, Chicago, IL (US)

(72) Inventors: Larry L. Savage, Chicago, IL (US); Ted R. Dabrowski, Chicago, IL (US); Colin A. Diehl, Chicago, IL (US); John D. Williams, Chicago, IL (US); Enrique J. Ruiz, Chicago, IL (US)

(73) Assignee: The Boeing Company, Chicago, IL (US)

( * ) Notice: Subject to any disclaimer, the term of this patent is extended or adjusted under 35 U.S.C. 154(b) by 38 days.

(21) Appl. No.: 15/490,750

(22) Filed: Apr. 18, 2017

(65) Prior Publication Data

US 2018/0301803 A1 Oct. 18, 2018

(51) Int. Cl.

| | |
|---|---|
| ***H01Q 1/00*** | (2006.01) |
| ***H01Q 3/24*** | (2006.01) |
| ***H01Q 15/00*** | (2006.01) |
| ***H01Q 21/22*** | (2006.01) |
| ***H01Q 21/00*** | (2006.01) |

(52) U.S. Cl.
CPC ..... *H01Q 3/24* (2013.01); *H01Q 15/0033* (2013.01); *H01Q 21/0031* (2013.01); *H01Q 21/22* (2013.01)

(58) Field of Classification Search
CPC .. H01Q 3/24; H01Q 21/0031; H01Q 15/0033; H01Q 21/22
USPC ..... 343/374, 876, 785, 701, 753, 904
See application file for complete search history.

(56) References Cited

U.S. PATENT DOCUMENTS

| | | | | |
|---|---|---|---|---|
| 5,748,151 | A * | 5/1998 | Kingston | H01Q 3/08 343/753 |
| 6,567,046 | B2 * | 5/2003 | Taylor | H01L 29/868 257/E29.336 |
| 6,801,790 | B2 * | 10/2004 | Rudrapatna | H01Q 1/246 342/374 |
| 7,145,512 | B2 * | 12/2006 | Metz | H01Q 1/366 343/701 |
| 2004/0041741 | A1 | 3/2004 | Hayes | |
| 2006/0244672 | A1 * | 11/2006 | Avakian | H01Q 3/443 343/785 |
| 2008/0258993 | A1 * | 10/2008 | Gummalla | H01Q 1/243 343/876 |
| 2011/0175791 | A1 * | 7/2011 | Ozdemir | H01Q 1/00 343/876 |
| 2013/0281036 | A1 * | 10/2013 | Kolokotronis | H01Q 1/246 455/115.1 |

(Continued)

*Primary Examiner* — Jean B Jeanglaude
(74) *Attorney, Agent, or Firm* — Haynes and Boone, LLP

(57) ABSTRACT

A reconfigurable antenna comprises a plurality of antenna feed elements, a plurality of plasma switches respectively associated with the antenna feed elements, and control circuitry for independently operating the plasma switches to selectively activate and deactivate the antenna feed elements. Each plasma switch may comprise a volume of inert gas, and a pair of electrodes spanning the respective volume of inert gas. The reconfigurable antenna may comprise a power supply for supplying a voltage to the pair of electrodes of each of plasma switch sufficient to ignite the respective inert gas volume into a plasma field to deactivate the respective antenna feed element. Each plasma switch may optionally be operated to attenuate each antenna feed element.

23 Claims, 8 Drawing Sheets

(56) References Cited

U.S. PATENT DOCUMENTS

| | | | | |
|---|---|---|---|---|
| 2015/0188210 | A1* | 7/2015 | Asrani ..... | H01Q 9/145<br>455/575.7 |
| 2016/0111793 | A1 | 4/2016 | Montgomery et al. | |
| 2016/0149287 | A1 | 5/2016 | Lam et al. | |

* cited by examiner

FIG. 5
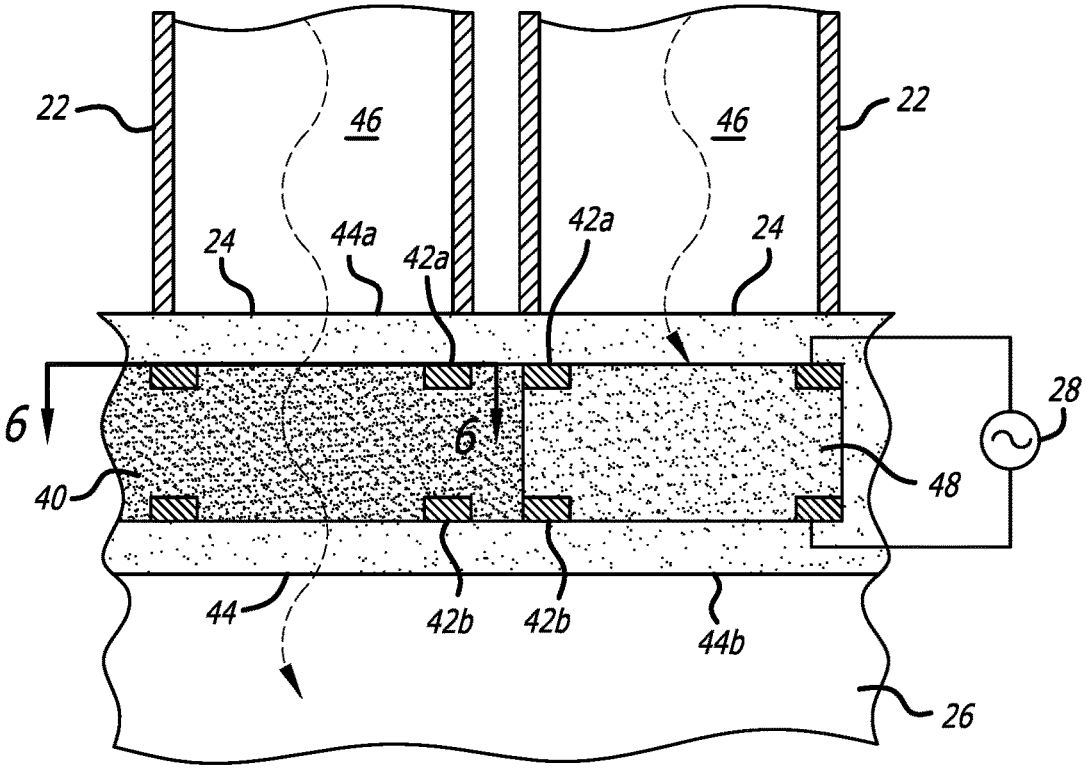
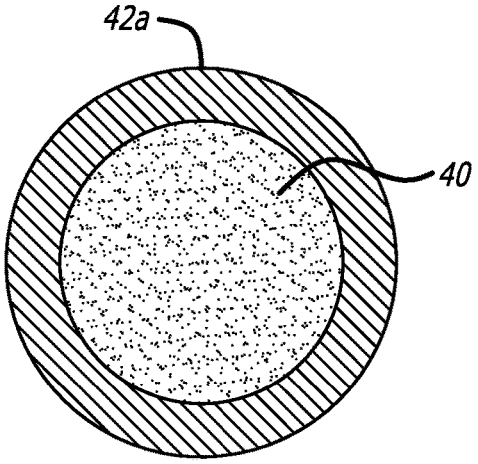
FIG. 6

FIG. 7
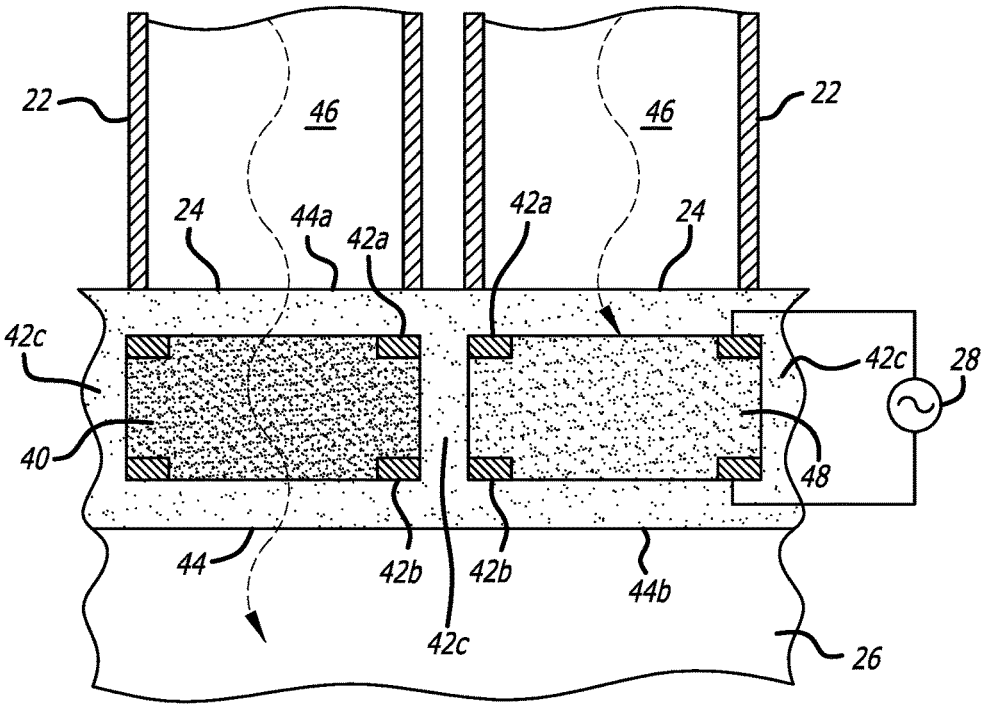
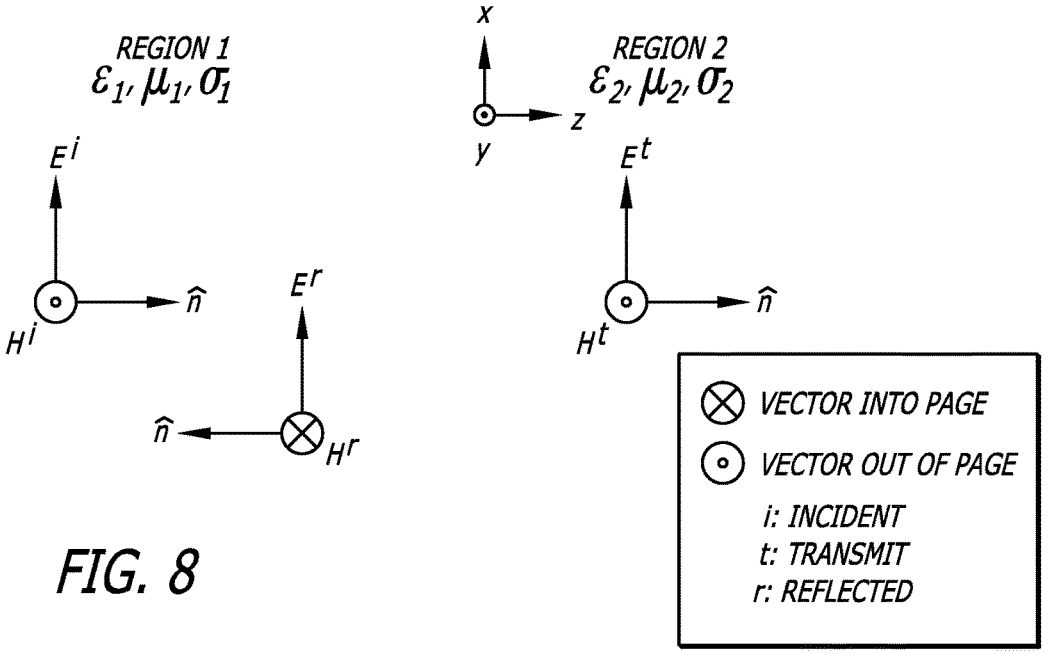
FIG. 8

PLASMA SWITCHED ARRAY ANTENNA

FIELD

The present disclosure generally relates to antennas, and more particularly, to reconfigurable antennas.

BACKGROUND

Reconfigurable antennas are antennas that can dynamically modify their frequency band, radiation pattern, polarization, and/or gain properties in a controlled and reversible manner, and have applications in the fields of cellular radio communications, geolocation, radar (ground, airplane, and unmanned airborne vehicle), smart weapons, etc. Of particular interest to the present disclosure are reconfigurable antennas that can dynamically modify its radiation pattern, e.g., by steering a radiation beam or changing the width of the beam.

Phased array antennas may be utilized to electronically steer a radiation beam through different angles, typically in the range of 60 degrees from the normal direction of the fixed physical array. Phased array antennas require that each element in the antenna array have an independent antenna element and radio frequency (RF) circuits that are aggregated to provide the overall antenna directivity, thereby creating an N-factor constraint that dictates a significant cost and power consumption penalty. Additionally, this N-factor constraint places significant circuit complexity on the antenna array, which limits production yield and operational reliability.

A simpler approach employs a mechanically articulatable antenna that includes a mechanical platform that physically moves or tilts the antenna unit to steer a radiation beam through different angles, typically in a range as much as ±90 degrees. Due to its simple electrical design, which requires only one antenna element, the N-factor constraint typically imposed on phased array antennas is avoided. However, mechanically articulatable antennas are typically slow in articulation, require moving parts that are subject to degradation, are physically very large and heavy, and are relatively expensive, thereby limiting the application of this technology.

Lens-based antenna approaches offer a viable and lower cost alternative to phased array and mechanically articulable antennas. For example, in one embodiment, multiple antenna feed elements can be placed around a spherical dielectric lens and selectively switched on and off to produce a wide field of beam coverage that avoids some of the engineering issues of phased array and mechanically articulatable antennas. However, although less technically complex than phased array antennas, reconfigurable lens-based antennas require multiple antenna feed elements and associated switches, and thus, still suffer from an N-factor constraint in terms of weight, power, size, and cost.

Of particular interest to the present disclosure are the switches used to selectively turn the antenna feed elements on and off. Various types of conventional switches that can be used for the antenna feed elements include servo-mechanical switches, ferrite switches, and pin-diode switches. Servo-mechanical switches are relatively slow, typically having switch speeds on the order of $10^{-3}$ seconds (or several kilohertz). Ferrite switches require a relatively large amount of power to operate. Pin-diode switches are relatively complicated and expensive. All known conventional switches, including servo-mechanical switches, ferrite switches, and pin-diode switches, require some type of transition from the antenna feed element to a board or to a connector, thereby introducing insertion losses and additional design complexity into the reconfigurable antenna design.

There, thus, remains a need for an improved mechanism for selectively switching antenna feed elements in a reconfigurable antenna.

SUMMARY

In accordance with a first aspect of the present disclosure, a reconfigurable antenna comprises a plurality of antenna feed elements (e.g., a plurality of waveguides). In one embodiment, the antenna feed elements are circular, although the antenna feed elements may alternatively be rectangular. In one embodiment, the reconfigurable antenna further comprises a focusing element (e.g., a dielectric lens, such as a spherical dielectric lens) having a focal plane on which the antenna feed elements are located.

The reconfigurable antenna further comprises a plurality of plasma switches respectively associated with the antenna feed elements. The reconfigurable antenna may further comprise a radio frequency (RF) combiner coupled to the antenna feed elements via the respective plasma switches. In one embodiment, each of the plasma switches comprises a volume of inert gas (e.g., Neon, Xenon, Argon, or a combination thereof) and a pair of electrodes (e.g., ring electrodes) spanning the respective inert gas volume. In such case, the reconfigurable antenna may further comprise a dielectric chamber containing the inert gas volumes. This dielectric chamber may comprise side walls that isolate the respective inert gas volumes from each other, with such inert gas volumes being at a pressure less than atmospheric pressure. The dielectric chamber may comprise a top dielectric wall in which a first one of the pair of electrodes of each plasma switch is incorporated, and a bottom dielectric wall in which a second one of the pair of electrodes of each plasma switch is incorporated. The reconfigurable antenna may further comprise a power supply for supplying a voltage to the pair of electrodes of each of the plasma switches sufficient (e.g., 100V-300V DC/AC-RMS) to ignite the respective inert gas volume into a plasma field (e.g., having a plasma density greater than $10^9$ free electrons per $cm^3$).

The reconfigurable antenna further comprises control circuitry for independently operating the plasma switches to selectively activate and deactivate the antenna feed elements. To this end, the control circuitry may be for selectively controlling the supply of the voltage from the power supply to the respective plasma switches to selectively turn the respective antenna feed elements on or off. In one embodiment, the control circuitry may be for independently operating the plasma switches to attenuate the antenna feed elements. In another embodiment, the control circuitry may be for independently operating the plasma switches to dynamically steer an RF beam. For example, the control circuitry may be for independently operating the plasma switches to selectively activate and then deactivate the respective antenna feed elements one at a time. As another example, the control circuitry may be for independently operating the plasma switches to alternately activate and then deactivate two halves of the antenna feed elements. In still another embodiment, the control circuitry is for independently operating the plasma switches to dynamically modify an aperture of a beam. In yet another embodiment, the control circuitry may be for independently operating the plasma switches to activate and then deactivate different group sizes of antenna feed elements.

In accordance with a second aspect of the present disclosure, an antenna comprises at least one feed element (e.g., at least one waveguide). In one embodiment, the antenna feed element(s) are circular, although the antenna feed element(s) may alternatively be rectangular. In one embodiment, the reconfigurable antenna further comprises a focusing element (e.g., a dielectric lens, such as a spherical dielectric lens) having a focal plane on which the antenna feed elements(s) are located.

The antenna further comprises at least one plasma switch respectively associated with the antenna feed element(s). If there are multiple antenna feed elements, the reconfigurable antenna may further comprise a radio frequency (RF) combiner coupled to the antenna feed elements via the respective plasma switches. Each of the plasma switch(es) comprises a volume of inert gas (e.g., Neon, Xenon, Argon, or a combination thereof), and a pair of electrodes spanning the respective volume of inert gas. In such case, the reconfigurable antenna may further comprise a dielectric chamber containing the inert gas volume(s). In the case of multiple plasma switches, this dielectric chamber may comprise side walls that isolate the respective inert gas volumes from each other, with such inert gas volumes being at a pressure less than atmospheric pressure. The dielectric chamber may comprise a top dielectric wall in which a first one of the pair of electrodes of each plasma switch is incorporated, and a bottom dielectric wall in which a second one of the pair of electrodes of each plasma switch is incorporated.

The antenna further comprises a power supply is for supplying a voltage to the pair of electrodes of each of the plasma switch(es) sufficient to ignite the respective inert gas volume into a plasma field. In one embodiment, the plasma field is capable of deactivating the respective antenna feed element (e.g., if the plasma density is greater than $10^9$ free electrons per $cm^3$). In another embodiment, the plasma field is capable of attenuating the respective antenna feed element (e.g., if the plasma density is between $10^7$-$10^9$ free electrons per $cm^3$).

In accordance with a third aspect of the present disclosure, an antenna comprises at least one feed element (e.g., at least one waveguide). In one embodiment, the antenna feed element(s) are circular, although the antenna feed element(s) may alternatively be rectangular. In one embodiment, the reconfigurable antenna further comprises a focusing element (e.g., a dielectric lens, such as a spherical dielectric lens) having a focal plane on which the antenna feed elements(s) are located.

The antenna further comprises at least one plasma switch respectively associated with the antenna feed element(s), and control circuitry for operating each of the plasma switch(es) to attenuate each of the antenna feed element(s). If there are multiple antenna feed elements, the reconfigurable antenna may further comprise a radio frequency (RF) combiner coupled to the antenna feed elements via the respective plasma switches. Each of the plasma switch(es) comprises a volume of inert gas (e.g., Neon, Xenon, Argon, or a combination thereof), and a pair of electrodes spanning the respective volume of inert gas. In such case, the reconfigurable antenna may further comprise a dielectric chamber containing the inert gas volume(s).

In the case of multiple plasma switches, this dielectric chamber may comprise side walls that isolate the respective inert gas volumes from each other, with such inert gas volumes being at a pressure less than atmospheric pressure. The dielectric chamber may comprise a top dielectric wall in which a first one of the pair of electrodes of each plasma switch is incorporated, and a bottom dielectric wall in which a second one of the pair of electrodes of each plasma switch is incorporated. The antenna may further comprise a power supply for supplying a voltage to the pair of electrodes of each of the plasma switches sufficient to ignite the respective inert gas volume into a plasma field (e.g., having a plasma density between $10^7$-$10^9$ free electrons per $cm^3$).

In accordance with a fourth aspect of the present disclosure, a radio frequency (RF) system comprise any of the antennas described above, and transmit and/or receive componentry coupled to the antenna feed element(s) via the respective plasma switch(es).

In accordance with a fifth aspect of the present disclosure, a method of operating an antenna comprising a focusing element having a focal plane, a plurality of antenna feed elements (e.g., waveguides) located on the focal plane, a plurality of plasma switches respectively associated with the antenna feed elements, and a radio frequency (RF) combiner coupled to the antenna feed elements via the plasma switches, is provided. In one embodiment, the antenna feed elements are circular, although the antenna feed elements may alternatively be rectangular. In one embodiment, the antenna further comprises a focusing element (e.g., a dielectric lens, such as a spherical dielectric lens) having a focal plane on which the antenna feed elements are located.

The method comprises (a) conveying RF energy between the focusing element and the RF combiner, (b) selecting a subset of the antenna feed elements (which may be a single antenna feed element), (c) independently operating the plasma switches to activate the subset of the antenna feed elements, thereby passing the RF energy through the corresponding subset of the plasma switches, and to deactivate remaining ones of the antenna feed elements, thereby blocking the RF energy through the corresponding remaining ones of the plasma switches, such that the antenna generates at least one RF beam having a characteristic, (d) selecting a different subset of the antenna feed elements, and (e) repeating step (c) with the different subset of antenna feed elements, such that the characteristic of the RF beam(s) is modified. As one example, the modified characteristic may be a directional angle of the RF beam(s). As another example, the modified characteristic may be an aperture of the RF beam(s). In still another example, the modified characteristic is a group size of the RF beam(s).

In one embodiment, each plasma switch may comprise a volume of inert gas (e.g., Neon, Xenon, Argon, or a combination thereof), in which case, operating the plasma switches to activate the subset of the antenna feed elements may comprise not applying an electric field across each inert gas volume of the subset of plasma switches, thereby passing the RF energy through the subset of plasma switches, and applying an electric field across each inert gas volume of the remaining ones of the plasma switches to ignite the each inert gas volume into a respective plasma field (e.g., one having a plasma density greater than $10^9$ free electrons per $cm^3$), thereby blocking the RF energy through the remaining ones of the plasma switches.

In accordance with a sixth aspect of the present disclosure, a method of geolocating an object of interest using an antenna comprising a focusing element having a focal plane, a plurality of antenna feed elements located on the focal plane, a plurality of plasma switches respectively associated with the antenna feed elements, and a radio frequency (RF) combiner coupled to the antenna feed elements via the plasma switches, is provided. In one embodiment, the antenna feed elements are circular, although the antenna feed elements may alternatively be rectangular. In one embodiment, the antenna further comprises a focusing element (e.g., a dielectric lens, such as a spherical dielectric lens) having a focal plane on which the antenna feed elements are located.

The method comprises (a) receiving RF energy from the object of interest at the focusing element, (b) selecting a subset of the antenna feed elements (which may be a single antenna feed element), (c) independently operating the plasma switches to activate the subset of the antenna feed elements, thereby passing the RF energy from the subset of antenna feed elements to the RF combiner, and to deactivate remaining ones of the antenna feed elements, thereby blocking the RF energy from the remaining antenna feed elements to the RF combiner, such that an RF beam having a directional angle from the focusing element is generated, (d) measuring a signal strength of the RF energy output by the RF combiner, (e) selecting a different subset of the antenna feed elements, (f) repeating steps (c)-(d) for the different subset of antenna feed elements, and (g) geolocating the object of interest based on the measured signal strength corresponding to at least one of the selected subsets of antenna feed elements. Steps (e) and (f) may be repeated until all possible subsets of antenna feed elements have been selected and activated.

In one embodiment, geolocating the object of interest comprises determining at least one subset of antenna feed elements corresponding to at least one of the highest measured signal strengths, correlating the directional angle of the RF beam to each of the subset(s) of antenna feed elements, and geolocating the object of interest based on the correlated directional angle(s) of the RF beam. If only one subset of antenna feed elements corresponding to the highest measured signal strength is determined, the directional angle of the RF beam may be correlated to the only one subset of antenna feed elements, and the object of interest may be geolocated by identifying the directional angle of the RF beam as the location of the object of interest. If multiple subsets of antenna feed elements corresponding to the highest measured signal strengths are determined, the directional angles of the RF beam may be correlated to the multiple subsets of antenna feed elements, and the object of interest may be geolocated by computing an interpolated directional angle from the directional angles of the RF beam based on the corresponding highest measured signal strengths, and identifying the interpolated angle of the RF beam as the location of the object of interest.

In another embodiment, each plasma switch may comprise a volume of inert gas (e.g., Neon, Xenon, Argon, or a combination thereof), in which case, operating the plasma switches to activate the subset of the antenna feed elements may comprise not applying an electric field across each inert gas volume of the subset of plasma switches, thereby passing the RF energy through the subset of plasma switches, and applying an electric field across each inert gas volume of the remaining ones of the plasma switches to ignite the each inert gas volume into a respective plasma field (e.g., one having a plasma density greater than $10^9$ free electrons per $cm^3$), thereby blocking the RF energy through the remaining ones of the plasma switches.

Other and further aspects and features of the disclosure will be evident from reading the following detailed description of the presented embodiments, which are intended to illustrate, not limit, the disclosure.

BRIEF DESCRIPTION OF DRAWINGS

The drawings illustrate the design and utility of the presented embodiments of the present disclosure, in which similar elements are referred to by common reference numerals. In order to better appreciate how the above-recited and other advantages and objects of the present disclosure are obtained, a more particular description of the present disclosure briefly described above will be rendered by reference to specific embodiments thereof, which are illustrated in the accompanying drawings. Understanding that these drawings depict only typical embodiments of the disclosure and are not therefore to be considered limiting of its scope, the disclosure will be described and explained with additional specificity and detail through the use of the accompanying drawings in which:

FIG. 5 is a cross-sectional view of one embodiment of plasma switches used in the reconfigurable antenna of FIG. 2;

FIG. 6 is a cross-sectional view of a plasma switch of FIG. 5, taken along the line 6-6;

FIG. 7 is a cross-sectional view of another embodiment of plasma switches used in the reconfigurable antenna of FIG. 2;

FIG. 8 is a plan view of an electromagnetic wave transmitted through and reflected from an interface between two media;

DETAILED DESCRIPTION

Figure 1:
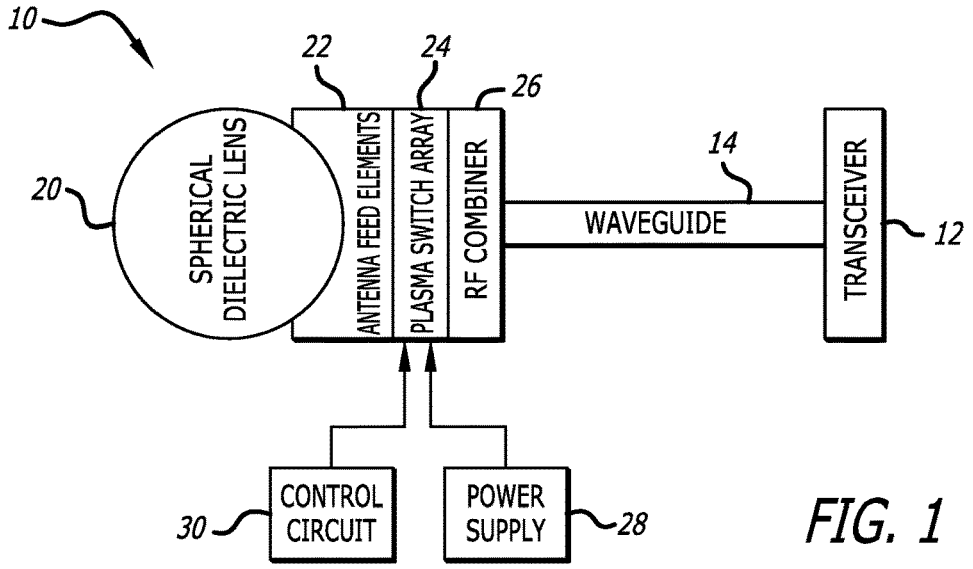
FIG. 1 is a block diagram of a radio frequency (RF) system constructed in accordance with one embodiment of the present disclosure.
Figure 2:
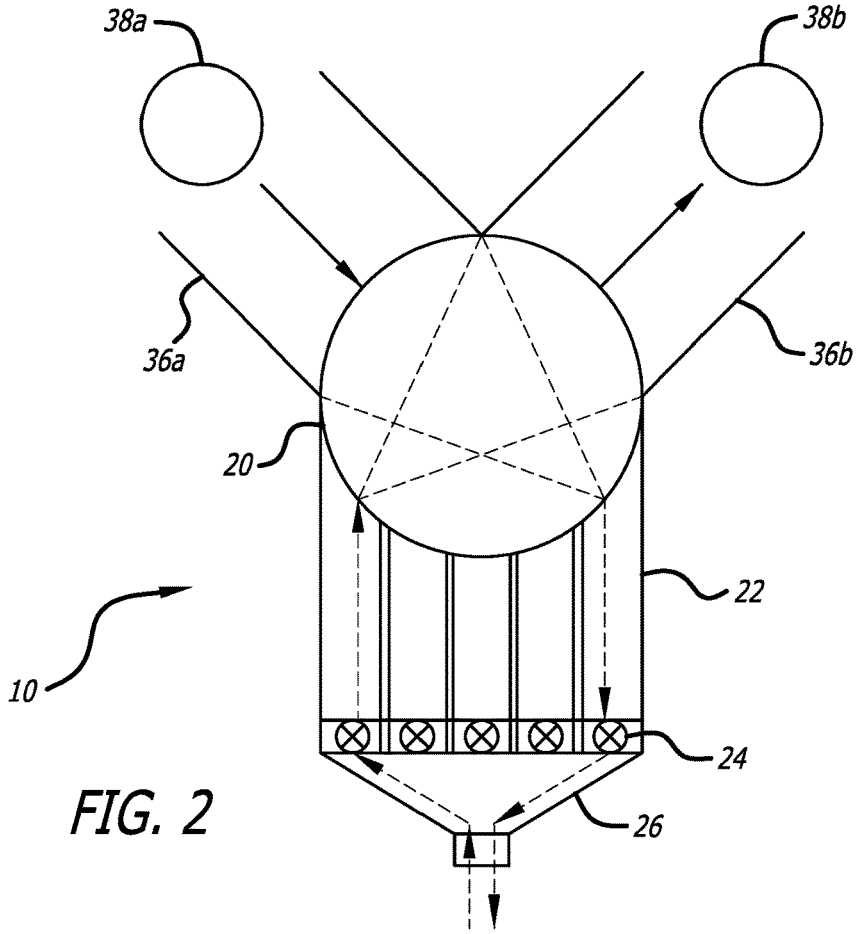
FIG. 2 is a plan view of a reconfigurable antenna used in the RF system of FIG. 1.
Figure 3:
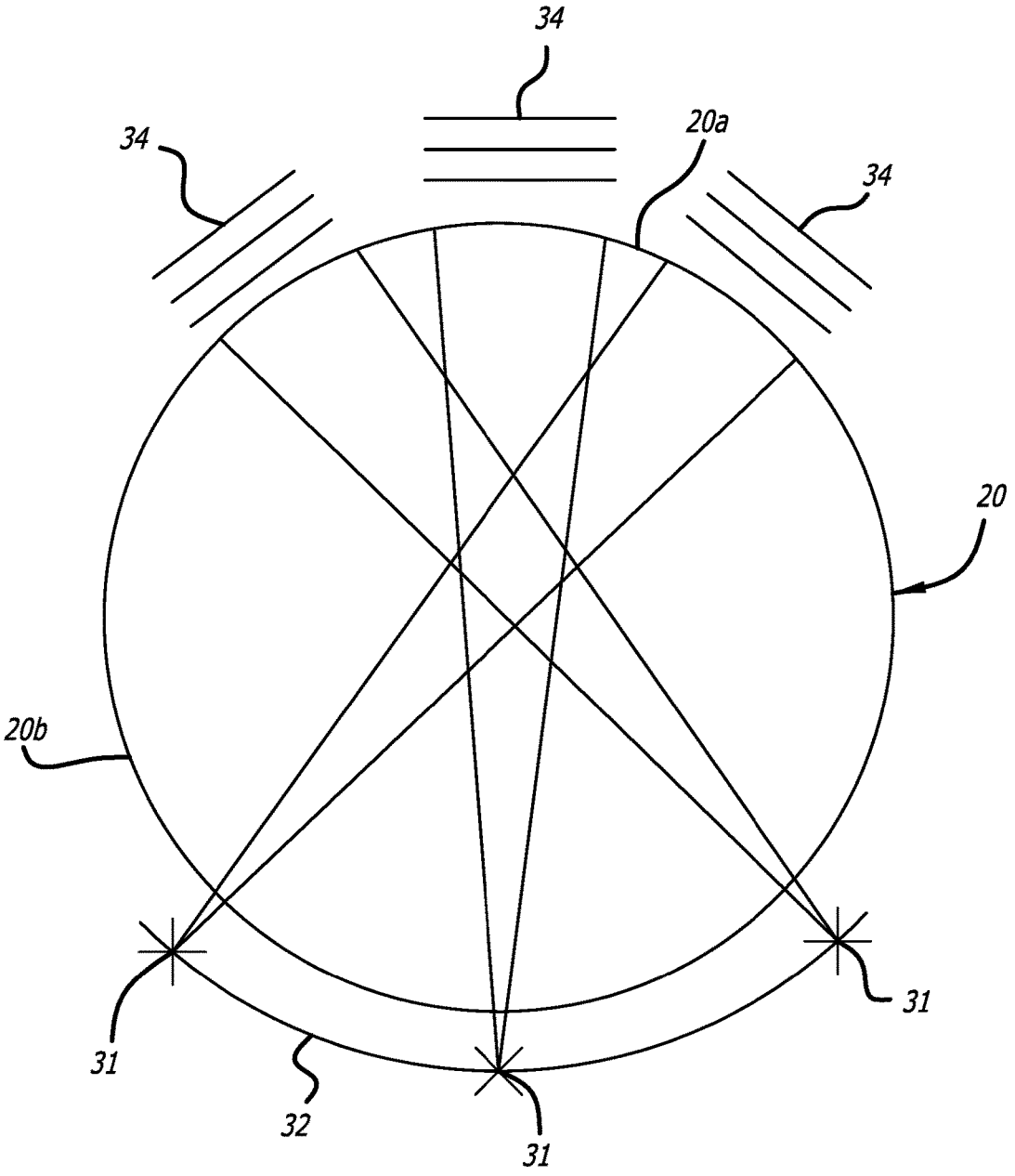
FIG. 3 is a plan view of a spherical dielectric lens used in the reconfigurable antenna of FIG. 2.

Referring to FIGS. 1-3, a reconfigurable antenna 10 constructed in accordance with one embodiment of the present disclosure will now be described. In a conventional manner, the reconfigurable antenna 10 is coupled to transmit and/or receive componentry in the form of a transceiver 12 that transmits and/or receives RF signals to and from the reconfigurable antenna 10 via a waveguide 14. The reconfigurable antenna 10, transceiver 12, and waveguide 14 form at least a portion of an RF system, such as an RF communications system or geolocation system. In the illustrated embodiment, the reconfigurable antenna 10 is mounted to the structural body of a communications platform, such as a building (e.g., a tracking station) or spacecraft (e.g., a communications satellite).

The reconfigurable antenna 10 comprises an RF focusing element 20, which in the illustrated embodiment, takes the form of a dielectric lens, and in particular, a spherical dielectric lens. In other embodiments, the RF focusing element 20 may take the form of flat lens, e.g., a bi-convex, a plano-convex lens, or a gradient-index (GRIN) lens. The spherical dielectric lens 20 is composed of a dielectric material having a suitable dielectric constant and loss tangent, such as polytetrafluoroethylene or polycarbonate. As best shown in FIG. 3, the spherical dielectric lens 20 exhibits the beneficial property of uniformity across its hemisphere 20*a*, so that RF plane waves 34 that are incident on this hemisphere 20*a* from respective particular directional arrival angles are predictably focused at corresponding points 31 along a spherical focal plane 32 adjacent the opposite hemisphere 20*b* of the spherical dielectric lens 20, and conversely, a RF energy emitted from points 31 along the focal plane 32 that are incident on the opposite hemisphere 20*b* predictably exits the hemisphere 20*a* as RF plane waves 34 at corresponding directional departure angles. As can be appreciated from the following discussion, the use of a spherical dielectric lens 20, as opposed to a phased antenna array, allows the use of a single waveguide 14 for routing RF signals between the reconfigurable antenna 10 and the transceiver 12, thereby providing for a simpler antenna design, while still allowing beam steering or beam aperture modification.

The reconfigurable antenna 10 further comprises an array of switchably selectable antenna feed elements 22, the apertures of which are located at selected points 31 around the focal plane 32 of the spherical dielectric lens 20. In the illustrated embodiment, each antenna feed element 22 takes the form of a waveguide. The focal plane 32 may be coincident with the surface of the spherical dielectric lens 20, such that the antenna feed elements 22 may be bonded directly to the surface of the spherical dielectric lens 20, although in presented embodiments, the focal plane 32 may be spatially offset from the surface of the spherical dielectric lens 20, in which case, the antenna feed elements 22 may be likewise spatially offset from the surface of the spherical dielectric lens 20, allowing the spherical dielectric lens 20 to be moved relative to the antenna feed elements 22 to align the apertures of the antenna feed elements 22 with the focal plane 32.

Thus, an incoming RF beam 36*a* emitted from an object of interest 38*a* (in this case, a source of RF radiation) may be incident on the surface of the spherical dielectric lens 20 and focused on one or more of the antenna feed elements 22. Conversely, RF energy emitted by one or more of the antenna feed elements 22 may be directed from the surface of the spherical dielectric lens 20 as an outgoing RF beam 36*b* to an object of interest 38*b*. When the reconfigurable antenna 10 is operated in a receive mode, the antenna feed elements 22 may be selectively and independently activated to allow the transceiver 12 to receive RF energy emitted by the object of interest 38*a*, and when the reconfigurable antenna 10 is operated in a transmit mode, the antenna feed elements 22 may be selectively and independently activated to allow the transceiver 12 to transmit RF energy to the object of interest 38*b*.

To this end, the reconfigurable antenna 10 further comprises an array of plasma switches 24 respectively associated with the antenna feed elements 22, and an RF combiner 26 coupled to the antenna feed elements 22 that serves to convey RF energy between the multiple antenna feed elements 22 and the single waveguide 14 coupled to the transceiver 12. In the illustrated embodiment, the plasma switches 24 are conveniently disposed between the respective antenna feed elements 22 and the RF combiner 26, although in alternative embodiments, the plasma switches 24 may be located anywhere in the path of the antenna feed elements 22.

In the illustrated embodiment, the reconfigurable antenna 10 is designed to transmit and receive circularly polarized RF energy (e.g., both left hand circularly polarized (LHCP) and right hand circularly polarized (RHCP)), although in alternative embodiments, the reconfigurable antenna 10 may be designed to transmit and receive linearly polarized RF energy (e.g., both horizontally polarized (HP) and vertically polarized (VP)). In the illustrated embodiment, the cross-sectional profile of the antenna feed elements 22, plasma switches 24, RF combiner 26, and waveguide 14 are circular, although in alternative embodiments, the cross-sectional profile may be rectangular.

As briefly discussed above, the antenna feed elements 22 may be selectively activated via the plasma switches 24. To this end, the reconfigurable antenna 10 further comprises a power supply 28 for supplying power to the plasma switches 24, and control circuitry 30 for independently operating the plasma switches 24 to selectively activate the respective antenna feed elements 22 by selectively controlling the supply of voltage from the power supply 28 to the respective plasma switches 24, as will be described in further detail below. In an optional embodiment, rather than turning the antenna feed element(s) 22 on or off, the control circuitry 30 may independently attenuate the antenna feed elements 22 by selectively controlling the supply of voltage form the power supply 28 to the respective plasma switches 24.

Figure 4A:
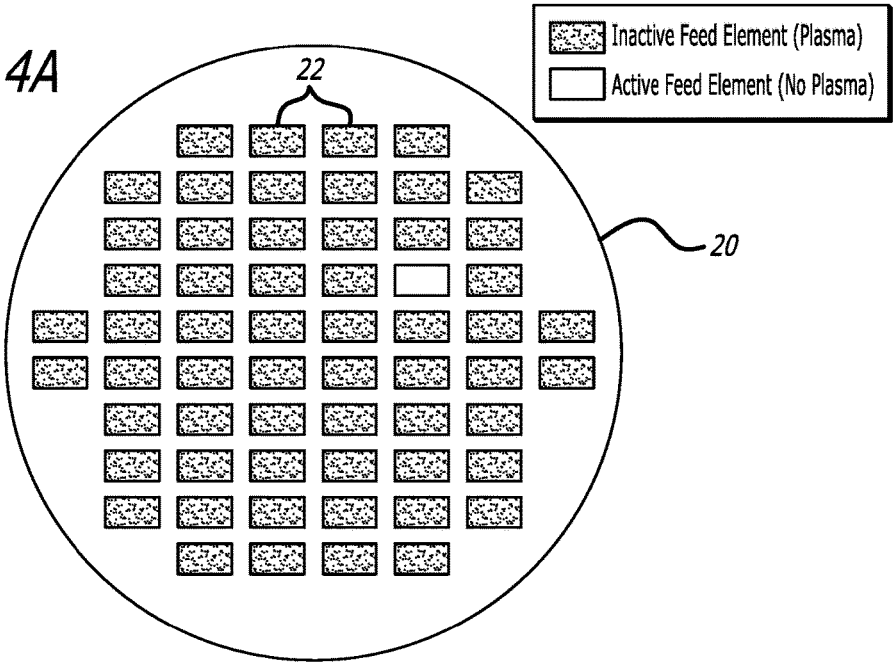
FIG. 4*a* is a plan view of an array of antenna feed elements used in the reconfigurable antenna of FIG. 2, particularly showing one configuration of activated antenna feed elements.
Figure 4B:
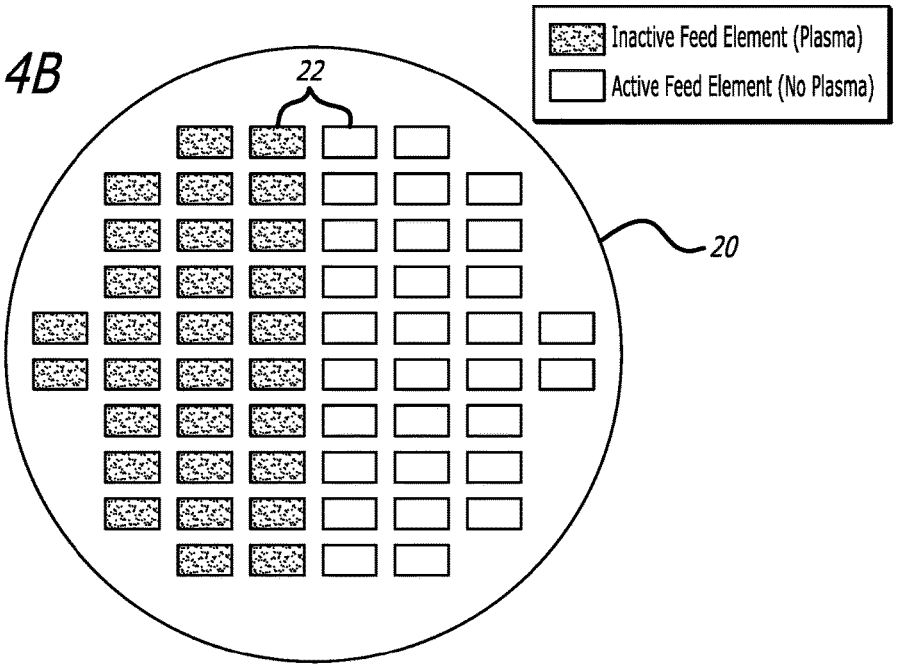
FIG. 4*b* is a plan view of an array of antenna feed elements used in the reconfigurable antenna of FIG. 2, particularly showing another configuration of activated antenna feed elements.

The control circuitry 30 may be for independently operating the plasma switches 24 via the power supply 28 to dynamically steer the RF beam. In one example illustrated in FIG. 4*a*, the control circuitry 30 may independently operate the plasma switches 24 to direct the RF beam towards a small portion of the sky by activating and then deactivating only one antenna feed element 22 at a time. As another example illustrated in FIG. 4*b*, the control circuitry 30 may independently operate the plasma switches 24 to direct the RF beam towards half of the sky by activating a first contiguous half of the antenna feed elements 22 while deactivating the second contiguous half of the antenna feed elements 22, and then activating the second contiguous half of the antenna feed elements 22 while deactivating the first contiguous half of the antenna feed elements 22.

Figure 4C:
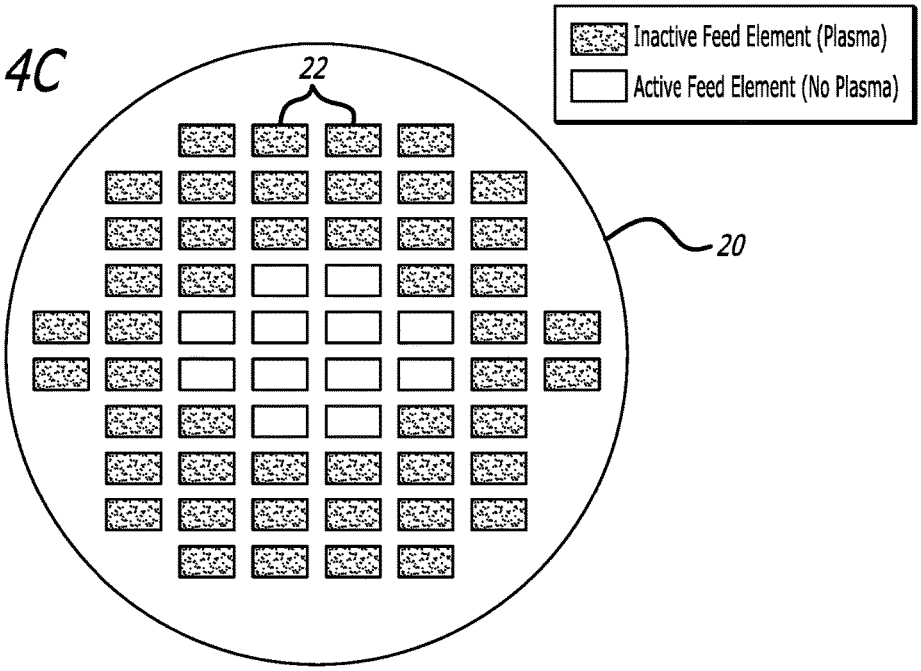
FIG. 4*c* is a plan view of an array of antenna feed elements used in the reconfigurable antenna of FIG. 2, particularly showing still another configuration of activated antenna feed elements.
Figure 4D:
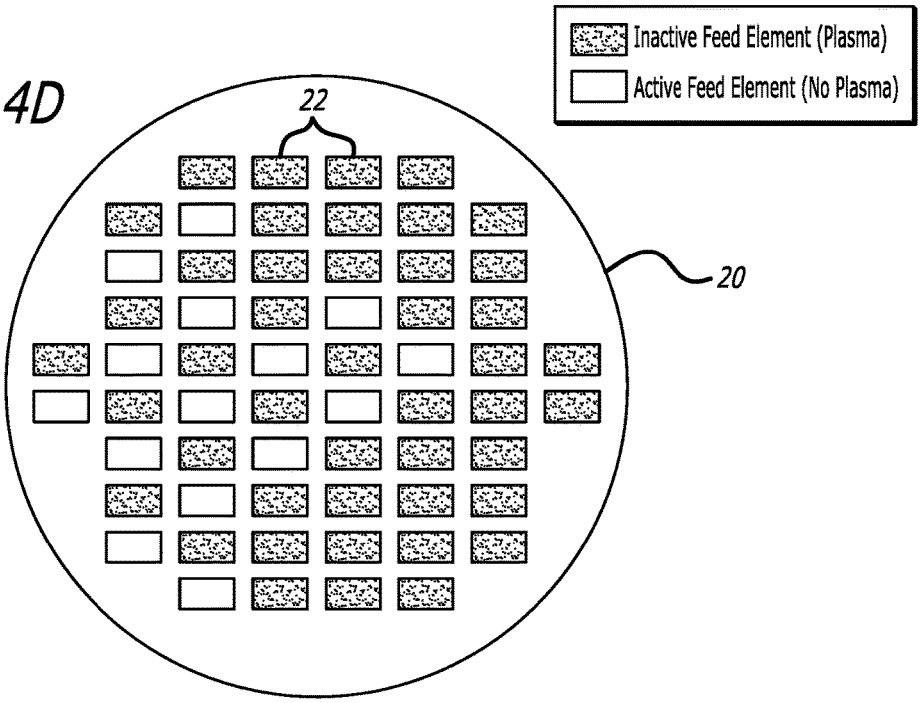
FIG. 4*d* is a plan view of an array of antenna feed elements used in the reconfigurable antenna of FIG. 2, particularly showing yet another configuration of activated antenna feed elements.

The control circuitry 30 may also be for independently operating the plasma switches 24 to dynamically modify an aperture of the RF beam. As one example illustrated in FIG. 4*c*, the control circuitry 30 may independently operate the plasma switches 24 to modify the aperture of the RF beam by activating different sized ellipsoidal groups of antenna feed elements 22. The control circuitry 30 may also be for independently operating the plasma switches 24 to dynamically generate different groupings of multiple RF beams 36. As one example illustrated in FIG. 4*d*, the control circuitry 30 may independently operate the plasma switches 24 to generate fifteen RF beams by activating fifteen corresponding antenna elements 22.

It can be appreciated from the foregoing that the reconfigurable antenna 10 may be utilized to geolocate the object of interest 38, and depending on the particular application, to communicate with such object of interest 38. For example, the specific direction of arrival of the incoming RF beam 36*a*, and thus, the angular location of the object of interest 38, may be ascertained by interrogating the antenna feed elements 22, and in particular, by activating and deactivating selected ones of the antenna feed elements 22, and determining the particular antenna feed element(s) 22 that receive RF energy from the object of interest 38. The antenna feed element(s) 22 that receive the RF energy from the object of interest 38 can then be selected to communicate (either in receive mode to receive RF energy or transmit mode to transmit RF energy) with the geolocated object of interest 38.

Referring now to FIGS. 5 and 6, one embodiment of a plasma switch 24 will be described in further detail. Each plasma switch 24 comprises a volume of inert gas 40 disposed in a signal path between the aperture of the respective antenna feed element 22 and the RF combiner 26, a pair of electrodes 42 spanning the inert gas volume 40, and a dielectric chamber 44 containing the inert gas volume 40.

In the illustrated embodiment, the inert gas volume 40 is located between the end of the antenna feed element 22 and the RF combiner 26, although the volume of inert gas 40 may be disposed in the middle of the antenna feed element 22 if desired. The inert gas volume 40 may comprise, e.g., Neon, Xenon, or Argon, or a combination thereof to minimize corrosion of the electrodes 42, although the inert gas volume 40 may alternatively comprise air if the electrodes 42 are not exposed to the inert gas volume 40.

In the illustrated embodiment, both electrodes 42 are ring electrodes that are disposed around the circumference of the inner cavity of the respective antenna feed element 22 to minimize interference of RF signals propagating within the antenna feed element 22 when activated. Because in the illustrated embodiment, the cross-section of the antenna feed element 22 is circular, the ring electrode 42 will likewise be circular. However, in the case where the cross-section of the antenna feed element 22 is rectangular, the ring electrode 42 will be rectangular. In alternative embodiments, the electrodes 42 may take other forms that do not significantly interfere with the RF signal propagating through the antenna feed element 22 when activated.

The dielectric chamber 44 can be composed of any suitable dielectric material (e.g., glass) that is essentially transparent to RF energy and that is capable of containing the inert gas volume 40. The dielectric chamber 44 comprises a top wall 44*a* (or layer) in which the top electrode 42*a* is incorporated, and a bottom wall 44*b* (or layer) in which the bottom electrode 42*b* is incorporated. The electrodes 42 may be suitably patterned onto or within the respective top and bottom dielectric walls 44. Notably, the top wall 44*a* and bottom wall 44*b* of the dielectric chamber 44 may span the entire array of plasma switches 24, such that a single top wall 44*a* and a single bottom wall 44*b* may be used to contain all of the inert gas volumes 40 in the array of plasma switches 24. As illustrated in FIG. 7, the dielectric chamber 44 may optionally comprise side walls 44*c* that isolate the respective inert gas volumes 40 for the plasma switches 24 from each other.

Each plasma switch 24 is capable of transforming the respective inert gas volume 40 into plasma, which is an ionized gas consisting of positive ions and free electrons, and is one of the four fundamental states of matter. Like a gas, a plasma does not have a definite shape or volume. However, unlike a gas, a plasma is electrically conductive. A plasma can be created by heating a gas to a high temperature or by subjecting a gas to a strong electric field.

The power supply 28 is electrically coupled between the electrodes 42 of each respective plasma switch 24 via insulated wires (not shown) incorporated into the respective top and bottom dielectric walls 44*a*, 44*b*. Under control of the control circuitry 30, the power supply 28 is capable of supplying a voltage potential between the electrodes 42 of each respective plasma switch 24 to ignite the respective inert gas volume 40 into a plasma field 48, and terminating the supply of the voltage potential between the electrodes 42 to extinguish the plasma field 48. Thus, the plasma switch 24 operates like a virtual "door" within the respective antenna feed element 22 in that the energized plasma field 48 generates a virtual wall that blocks the RF energy through the plasma switch 24 between the respective antenna feed element 22 and the RF combiner 26 (thereby deactivating that antenna feed element 22), and the lack of the energized plasma field 48 generates a window that allows the RF signal to seamlessly pass through the plasma switch 24 between the respective antenna feed element 22 and the RF combiner 26 (thereby activating that antenna feed element 22). In some embodiments, instead of completely blocking the RF signal propagating within the antenna feed element 22, the plasma field 48 may attenuate the RF energy propagating through the antenna feed element 22 to the RF combiner 26.

Notably, a plasma is defined by three parameters, which must meet three conditions. First, a plasma has a Debye length over which an imposed electric field can be neutralized, defined as $$\lambda_D\left(\frac{\varepsilon_0 k T_e}{n_0 e^2}\right)^{\frac{1}{2}},$$

where $\varepsilon_0$ is the vacuum permittivity, k is the Boltzmann constant, $T_e$ is the electron temperature, $n_0$ is the plasma density, and e is the elementary charge. A plasma requires that $\lambda_D \ll L$, where L is the physical extent of the plasma. Therefore, the physical extent of the plasma must be many times greater than the Debye length so that it can "screen" an imposed electric field. Second, a plasma has a plasma parameter that is the number of electrons contained with the Debye length $\lambda_D$, defined as $\Lambda = 4/3\pi\lambda_D^3 n_0$. A plasma requires that $\Lambda \gg 1$, such that there are many free electrons in the plasma. Third, a plasma has a plasma frequency that is the frequency of the oscillations of the electron density, defined as $$\omega_{pe} = \left(\frac{n_0 e^2}{\epsilon_0 m_e}\right)^{\frac{1}{2}},$$

where $m_e$ is the electron mass. A plasma requires that $\omega_{pe}\tau \gg 1$, where $\tau$ is the electron collision time, requiring that the natural oscillations of the plasma occur at the plasma frequency.

In one embodiment, the power supply 28 is an RF power supply 28 having a typical RF frequency, such as, e.g., 900 MHz, 2.4 GHz, and 13.56 GHz, although the power supply 28 can take the form of a typical 60 Hz power supply used for standard Neon light bulbs, or can even be DC. The voltage potential supplied to the electrodes 42 by the power supply 28 is preferably high enough, and the distance between the electrodes 42 is preferably close enough, such that the inert gas volume 40, at given chamber pressure, will be ignited into the plasma field 48 in accordance with the three conditions for generating the plasma field 46 set forth above.

If the inert gas volumes 40 of the respective plasma switches 24 are not isolated from each other, as illustrated in FIG. 5, the inert gas volumes 40 are preferably maintained at atmospheric pressure, and the distance between the electrodes 42 of each plasma switch 24 are preferably less than 0.2 of the distance between adjacent plasma switches 24, thereby minimizing the possibility that the energized electrodes 42 of one plasma switch 24 will ignite the inert gas volume 40 of an adjacent plasma switch 24 into a plasma field 48; that is, ignition of the inert gas volume 40 into the plasma field 48 will be localized to the plasma switch 24 that is energized. However, if the inert gas volumes 40 of the respective plasma switches 24 are isolated from each other via the dielectric side walls 44*c*, as illustrated in FIG. 7, the ignition of the inert gas volume 40 into the plasma field 48 will naturally be localized to the plasma switch 24 that is energized, the distance between the electrodes 42 of each plasma switch 24 may be greater than 0.2 of the distance between adjacent plasma switches 24. Furthermore, the inert gas volumes 40 may be maintained at a pressure substantially less than atmospheric pressure (e.g., 0.1 to 10 Torr cm), thereby enhancing ignition of the inert gas volume 40 into the respective plasma field 48 in response to the supply of the voltage potential to the respective electrodes 42.

The switch times for the plasma switch 24 are on the order of microseconds to seconds, based on the time required to activate the plasma field 48. Theoretically, the plasma field 48 may be activated in the time it takes to establish a standing wave for the frequency generated by the power supply 28. Typical ionization rate constants for ionization are on the order of $10^{-12}$ s ($10^{12}$ Hz) with relaxation times of $10^{-8}$ s ($10^{8}$ Hz) or faster. Preferably, the operating frequency of the power supply 28 is less than the relaxation time of the plasma field 48 to conserve power.

It is desirable that the plasma field 48 have an effective permittivity $\varepsilon_n$, such that the desired blocking or attenuation characteristics of the plasma field 48 with respect to the RF signal propagating within the respective antenna feed element 22 are achieved. In particular, with reference to FIG. 8, consider a plane wave that is propagating along the positive z-axis with its electric field oriented in the x-direction. This plane wave is incident on an interface separating two media (Region 1 and Region 2), each with a unique permittivity $\varepsilon$, permeability $\mu$, conductivity $\sigma$. Region 1 can be considered the media within the antenna feed element 22 (e.g., air), whereas region 2 can be considered the plasma field 48 within the plasma switch 24. To satisfy the boundary condition between Region 1 and Region 2, some of the energy from the incident wave must be reflected off the interface, as illustrated in FIG. 5.

Two parameters that predict the amplitude of the transmitted and reflected waves can be developed. One parameter is known as the transmission coefficient $$\hat{T} = \frac{2\hat{n}_2}{\hat{n}_1 + \hat{n}_2},$$

and the other parameter is known as the reflection coefficient $$\hat{\Gamma} = \frac{\hat{n}_2 - \hat{n}_1}{\hat{n}_1 + \hat{n}_2},$$

where $\hat{n}$ is the wave impedance based on the properties of the medium, given by $$\hat{n} = \sqrt{\frac{\mu}{\varepsilon - j\frac{\sigma}{2\pi f}}}.$$

The reflection and transmission coefficients are related by $1+\hat{\Gamma}=\hat{T}$, with $-1 \le \hat{\Gamma} \le 0$ and $0 \le \hat{T} \le 1$. For total reflection of an interface, $\hat{\Gamma}=-1$, causing $\hat{T}=0$, and for no reflection, $\hat{\Gamma}=0$, causing $\hat{T}=1$.

Thus, it can be appreciated that the plasma field 48 must provide a reflection coefficient at the interface of 1 for total blocking of the RF signal, and a reflection coefficient greater than 0, but less than 1, for attenuation of the RF signal. Associated with a plasma is an effective permittivity $\varepsilon_n$ equal to:

$$\frac{\varepsilon}{\varepsilon_0} = 1 - \frac{\left(\frac{\omega_{pe}}{\omega}\right)^2}{1 + \left(\frac{\gamma}{\omega}\right)^2} - j\frac{\left(\frac{\omega_{pe}}{\omega}\right)^2\left(\frac{\gamma}{\omega}\right)}{1 + \left(\frac{\gamma}{\omega}\right)^2},$$

$$\text{where } \omega = 2\pi f \text{ and } \omega_{pe} = \frac{n_e^2}{m_e \varepsilon_0}.$$

Thus, the effective permittivity $\varepsilon_n$ of plasma is controlled by the collision frequency $\gamma$, plasma frequency $\omega_{pe}$, and electron number density $n_e$. For a specified signal frequency f, there corresponds a critical electron density $n_{ec}$ for which $\omega_p=\omega$. The plasma is "underdense" when the plasma density $n_e<n_{ec}$, and "overdense" when $n_e>n_{ec}$. An overdense medium has a reflective constant of unity, so that the RF signal is completely blocked, and none of the RF signal is transmitted through the plasma field 48. An underdense medium can still provide attenuation to an RF signal (the attenuation increasing with the density of the plasma) by reflecting a portion of the incident RF signal. As a general rule, if the frequency of the RF signal is less than the resonant frequency of the plasma field 48, the RF signal will be blocked by the plasma switch 24, and if the frequency of the RF signal is greater than the resonant frequency of the plasma field 48, the RF signal will pass through the plasma switch 24.

The plasma density of the plasma field 48 will generally dictate the blocking or attenuating characteristics of the plasma switch 24 with respect to the RF energy propagating through the respective antenna feed element 22. For example, for RF energy having a frequency of several GHz, as a general rule, a plasma field 48 having a plasma density greater than $10^9$ free electrons per $cm^3$ will completely block RF energy incident on the plasma field 48, whereas a plasma field 48 having a plasma density in the range of $10^7$-$10^9$ free electrons per $cm^3$ will attenuate, at varying degrees, RF energy incident on the plasma field 48.

For the purposes of this specification, RF energy is blocked if less than ten percent of the RF energy passes through the plasma switch 24; however, it is preferred that less than one percent of the RF energy passes through the plasma switch 24 when the RF energy is blocked. The voltage applied to the electrodes 42 by the power supply 28 and the distance between the electrodes 42 can be selected to provide the desired blocking or attenuation (at various attenuation levels) of the RF energy of a given frequency through the plasma switch 24. The level of the voltage applied to the electrodes 42 by the power supply 28 to completely block the RF energy will generally be higher than the voltage applied to the electrodes 42 by the power supply 28 to attenuate the RF energy. By the same token, the greater the level of voltage applied to the electrodes 42 by the power supply 28, the greater the RF energy will be attenuated (if not otherwise completely blocked). For attenuation, several different voltage levels and corresponding attenuation levels may be stored in memory, such that the control circuitry 30, for any desired attenuation level for an antenna feed element 22, the control circuitry 30 may retrieve the corresponding voltage level from memory, and command the power supply 28 to deliver that that corresponding voltage level to the electrodes 42 of the plasma switch 24 corresponding to that antenna feed element 22.

Figure 9:
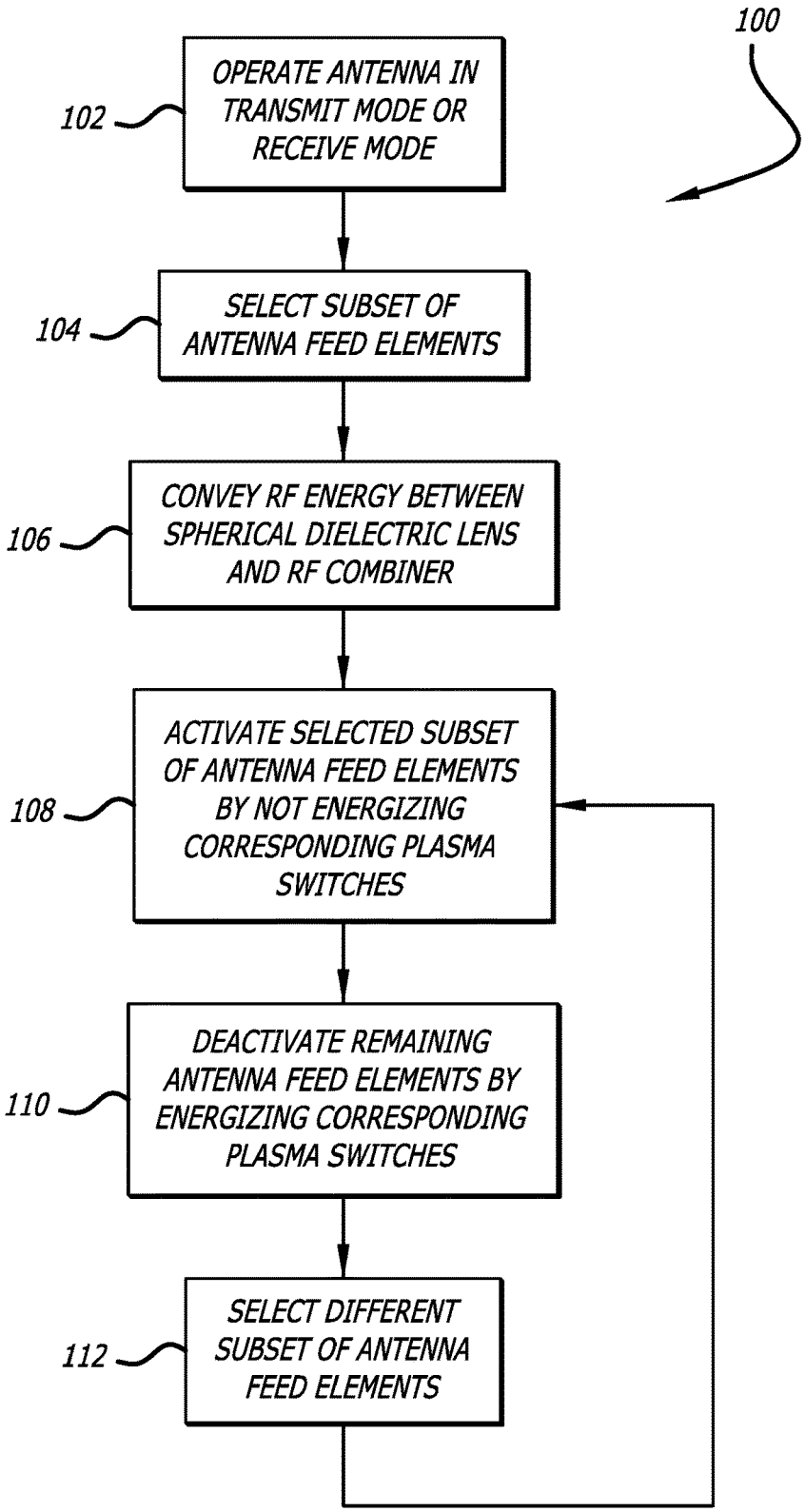
FIG. 9 is a flow diagram illustrating one method of operating the reconfigurable antenna of FIG. 2 to dynamically generate RF beams with differing characteristics.

Having described the arrangement, structure, and function of the reconfigurable antenna 10, one method 100 of operating the reconfigurable antenna 10 will now be described with respect to FIG. 9. First, the antenna 10 is operated in the transmit mode or receive mode (step 102). Next, a subset of the antenna feed elements 22 is selected (step 104). In the illustrated embodiment, the subset of antenna feed elements 22 is selected by the control circuitry 30. The subset of the antenna feed elements 22 may comprise, e.g., only a single antenna feed element, or may comprise multiple antenna feed elements. Then, RF energy is conveyed between the spherical dielectric lens 20 and the RF combiner 26 in accordance with the transmit mode or the receive mode (step 106). That is, in the receive mode, the RF energy is received from the object of interest 38*a* at the spherical dielectric lens 20, and in the transmit mode, the RF energy is transmitted from the spherical dielectric lens 20 to an object of interest 38*b*.

Then, the plasma switches 24 are independently operated to generate at least one RF beam 36 having a characteristic (e.g., a directional angle, an aperture, or a group size of the RF beam(s) 36). In particular, the subset of the antenna feed elements 22 is activated by not energizing the corresponding plasma switches 24, thereby passing the RF energy through the corresponding subset of the plasma switches 24 (step 108), and the remaining ones of the antenna feed elements are deactivated by energizing the corresponding plasma switches 24, thereby blocking the RF energy through the corresponding remaining ones of the plasma switches 24 (step 110).

In the illustrated embodiment, the control circuitry 30 activates the subset of plasma switches 24 by commanding the power supply 28 to not apply voltage across each pair of electrodes 42 of the subset of plasma switches 24. As a result, an electric field is not applied across each inert gas volume 40 of the subset of the plasma switches 24, such that the inert gas volume 40 is not ignited into a plasma field 46, thereby passing the RF energy through the subset of plasma switches 24. In contrast, the control circuitry 30 deactivates the remaining plasma switches 24 by commanding the power supply 28 to apply voltage across each pair of electrodes 42 of the remaining plasma switches 24. As a result, an electric field is applied across each inert gas volume 40 of the remaining plasma switches 24, such that the inert gas volume 40 is ignited into a plasma field 46, thereby blocking the RF energy through the remaining plasma switches 24.

Next, a different subset of the antenna feed elements 22 is selected (step 112), and the plasma switches 24 are independently operated again at steps 108 and 110 to modify the characteristic of the RF beam(s) 36. Steps 108 and 110 can be repeated to continually modify the characteristic of the RF beam(s) 36 as many times as desired.

Figure 10:
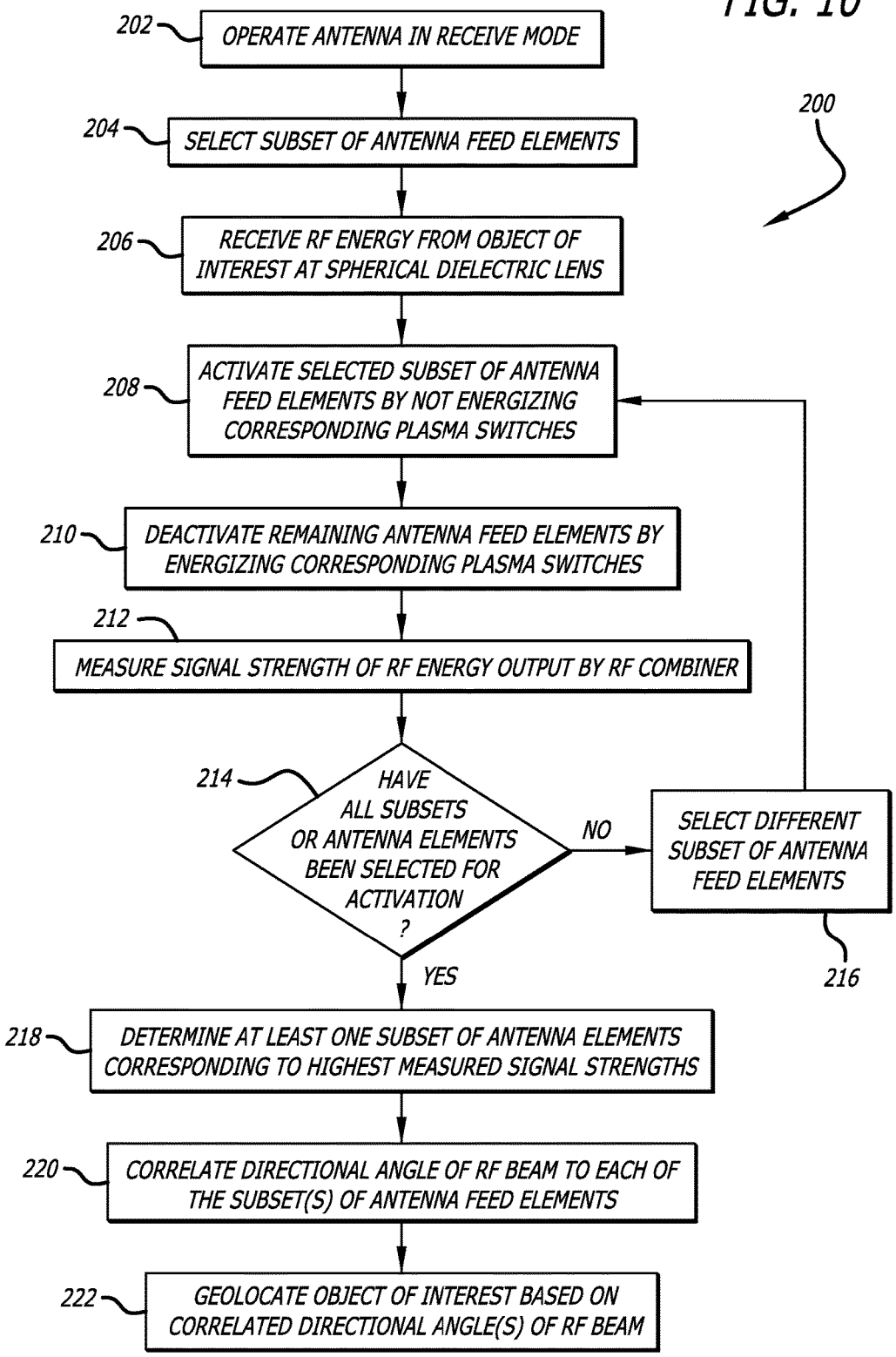
FIG. 10 is a flow diagram illustrating one method of operating the reconfigurable antenna of FIG. 2 to geolocate an object of interest.

Another method 200 of operating the reconfigurable antenna 10 to geolocate an object of interest 38*a* will now be described with respect to FIG. 10. First, the antenna 10 is operated in the receive mode (step 202). Next, a subset of the antenna feed elements 22 is selected (step 204). In the illustrated embodiment, the subset of antenna feed elements 22 is selected by the control circuitry 30. For detailed geolocation of the object of interest 38*a*, the subset of the antenna feed elements 22 preferably includes only a single antenna feed element (e.g., if the object of interest 38*a* is to be located in a very small area of the sky), although in alternative embodiments, the subset of antenna feed elements 22 may comprise multiple antenna feed elements (e.g., if the object of interest 38*a* is to be located in large area of the sky). Then, RF energy is received from the object of interest 38*a* at the spherical dielectric lens 20 (step 206).

Then, the plasma switches 24 are independently operated to generate an RF beam 36*a* having a directional angle from the focusing element 20 is generated. In particular, the subset of the antenna feed elements is activated by not energizing the corresponding plasma switches 24, thereby passing the RF energy from the subset of antenna feed elements 22 to the RF combiner 26 (step 208), and the remaining ones of the antenna feed elements are deactivated by energizing the corresponding plasma switches 24, thereby blocking the RF energy from the antenna feed elements 22 to the RF combiner 26 (step 210).

In the illustrated embodiment, the control circuitry 30 activates the subset of plasma switches 24 by commanding the power supply 28 to not apply voltage across each pair of electrodes 42 of the subset of plasma switches 24. As a result, an electric field is not applied across each inert gas volume 40 of the subset of the plasma switches 24, such that the inert gas volume 40 is not ignited into a plasma field 46, thereby passing the RF energy through the subset of plasma switches 24. In contrast, the control circuitry 30 deactivates the remaining plasma switches 24 by commanding the power supply 28 to apply voltage across each pair of electrodes 42 of the remaining plasma switches 24. As a result, an electric field is applied across each inert gas volume 40 of the remaining plasma switches 24, such that the inert gas volume 40 is ignited into a plasma field 46, thereby blocking the RF energy through the remaining plasma switches 24.

Next, the signal strength of the RF energy output by the RF combiner 26 is measured, e.g., by the transceiver 12 (step 212). Then, it is determined whether or not all possible subsets of antenna feed elements 22 have been selected for activation (step 214). If not, different subsets of the antenna feed elements 22 are selected (step 216), and the plasma switches 24 are independently operated again at steps 208 and 210 to modify directional angle of the RF beam 36*a* and the RF energy output by the RF combiner 26 is measured at step 212.

If all the possible subsets of antenna feed elements 22 have been determined to be selected for activation at step 214, the object of interest 38*a* is geolocated based on the measured signal strength corresponding to at least one of the selected subsets of antenna feed elements 22, e.g., by the control circuitry 30. In particular, at least one subset of antenna feed elements 22 corresponding to at least one of the highest measured signal strengths is determined (step 218), the directional angle of the RF beam 36*a* is correlated to each of these subset(s) of antenna feed elements 22 (step 220), and the object of interest 38*a* is geolocated based on the correlated directional angle(s) of the RF beam 36*a*. Correlation can be accomplished, e.g., by storing in memory directional angles corresponding to the respective subsets of the antenna feed elements 22, and retrieving the directional angle corresponding to the subset(s) of antenna feed elements 22 corresponding to the highest measured signal strength(s).

In one embodiment, only one subset of antenna feed elements 22 corresponding to the highest measured signal strength is determined, in which case, the directional angle of the RF beam 36*a* can be correlated to only this subset of antenna feed elements 22, and the object of interest 38*a* is geolocated by identifying the directional angle of the RF beam 36*a* as the location of the object of interest 38*a*. In another embodiment, multiple subsets of antenna feed elements 22 corresponding to the highest measured signal strengths are determined, in which case, the directional angles of the RF beam 36*a* are correlated to the multiple subsets of antenna feed elements 22, and the object of interest 38*a* is geolocated by computing an interpolated directional angle from the directional angles of the RF beam 36*a* based on the corresponding highest measured signal strengths, and identifying the interpolated angle of the RF beam 36*a* as the location of the object of interest 38*a*. For example, the directional angles can be weighted in accordance with the measured signal strengths corresponding to the multiple subsets of antenna feed elements 22, and then averaged to obtain the interpolated directional angle.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A reconfigurable antenna, comprising:

a plurality of antenna feed elements;

a plurality of plasma switches respectively associated with the antenna feed elements, wherein each of the plasma switches comprises a volume of inert gas and a pair of electrodes spanning the respective inert gas volume; and control circuitry for independently operating the plasma switches to selectively activate and deactivate the antenna feed elements.

2. The reconfigurable antenna of claim 1, further comprising a focusing element having a focal plane on which the antenna feed elements are located.

3. The reconfigurable antenna of claim 2, wherein the focusing element is a dielectric lens.

4. The reconfigurable antenna of claim 3, wherein the dielectric lens is a spherical dielectric lens.

5. The reconfigurable antenna of claim 1, further comprising a dielectric chamber containing the inert gas volumes.

6. The reconfigurable antenna of claim 1, wherein the control circuitry is for independently operating the plasma switches to attenuate the antenna feed elements.

7. The reconfigurable antenna of claim 1, further comprising a radio frequency (RF) combiner coupled to the antenna feed elements via the respective plasma switches.

8. The reconfigurable antenna of claim 1, further comprising a power supply for supplying a voltage to the pair of electrodes of each of the plasma switches sufficient to ignite the respective inert gas volume into a plasma field.

9. The reconfigurable antenna of claim 8, wherein the control circuitry is for selectively controlling the supply of the voltage from the power supply to the respective plasma switches to selectively turn the respective antenna feed elements on or off.

10. The reconfigurable antenna of claim 1, wherein the control circuitry is for independently operating the plasma switches to dynamically steer an RF beam.

11. The reconfigurable antenna of claim 10, wherein the control circuitry is for independently operating the plasma switches to selectively activate and then deactivate the respective antenna feed elements one at a time.

12. An antenna, comprising:

at least one antenna feed element;

at least one plasma switch respectively associated with the at least one antenna feed element, wherein each of the at least one plasma switch comprises a volume of inert gas, and a pair of electrodes spanning the respective volume of inert gas; and a power supply for supplying a voltage to the pair of electrodes of each of the at least one plasma switch sufficient to ignite the respective inert gas volume into a plasma field.

13. The antenna of claim 12, further comprising a focusing element having a focal plane on which the antenna feed element is located.

14. The antenna of claim 13, wherein the focusing element is a dielectric lens.

15. The antenna of claim 14, wherein the dielectric lens is a spherical dielectric lens.

16. The antenna of claim 12, wherein the plasma field is capable of deactivating the respective antenna feed element.

17. The antenna of claim 12, wherein the plasma field is capable of attenuating the respective antenna feed element.

18. The antenna of claim 12, wherein the at least one antenna feed element comprises a plurality of antenna feed elements, and the at least one plasma switch comprises a plurality of plasma switches.

19. The antenna of claim 18, further comprising a radio frequency (RF) combiner coupled to the antenna feed elements.

20. A method of operating an antenna comprising a focusing element having a focal plane, a plurality of antenna feed elements located on the focal plane, a plurality of plasma switches respectively associated with the antenna feed elements, and a radio frequency (RF) combiner coupled to the antenna feed elements via the plasma switches, the method comprising:

(a) conveying RF energy between the focusing element and the RF combiner;

(b) selecting a subset of the antenna feed elements;

(c) independently operating the plasma switches to activate the subset of the antenna feed elements, thereby passing the RF energy through the corresponding subset of the plasma switches, and to deactivate remaining ones of the antenna feed elements, thereby blocking the RF energy through the corresponding remaining ones of the plasma switches, such that the antenna generates at least one RF beam having a characteristic;

(d) selecting a different subset of the antenna feed elements;

(e) repeating step (c) with the different subset of antenna feed elements, such that the characteristic of the at least one RF beam is modified.

21. The method of claim 20, wherein the characteristic of the at least one RF beam is a directional angle of the at least one RF beam.

22. The method of claim 20, wherein the characteristic of the at least one RF beam is an aperture of the at least one RF beam.

23. The method of claim 20, wherein the characteristic of the at least one RF beam is a group size of the at least one RF beam.

* * * * *